United States Patent [19]

Buckland

[11] Patent Number: 4,657,262

[45] Date of Patent: Apr. 14, 1987

[54] SHUTTLECOCKS

[76] Inventor: Roy W. Buckland, 35, Pennycroft, Pixton Way, Forestdale, Croydon, CRO 9LL, England

[21] Appl. No.: 714,458

[22] Filed: Mar. 21, 1985

[30] Foreign Application Priority Data

Mar. 22, 1984 [GB] United Kingdom ..... 8407405
Apr. 10, 1984 [GB] United Kingdom ..... 8409276

[51] Int. Cl.[4] ..... A63B 67/18
[52] U.S. Cl. ..... 273/417
[58] Field of Search ..... 273/417

[56] References Cited

U.S. PATENT DOCUMENTS

| | | | |
|---|---|---|---|
| 2,116,304 | 5/1938 | Crespin | 273/417 |
| 2,153,251 | 4/1939 | Hudson | 273/417 |
| 2,338,274 | 1/1944 | Yancey | 273/417 |
| 2,613,935 | 10/1952 | Richards | 273/417 |
| 2,666,643 | 1/1954 | Miller | 273/417 |
| 2,734,746 | 2/1956 | Sametz et al. | 273/417 |
| 3,752,479 | 8/1973 | Chung | 273/417 |

FOREIGN PATENT DOCUMENTS

| | | | |
|---|---|---|---|
| 216536 | 2/1958 | Australia | 273/417 |
| 475985 | 2/1972 | Japan | 273/417 |
| 9200 | 4/1910 | United Kingdom | 273/417 |
| 820179 | 9/1959 | United Kingdom | 273/417 |
| 1336262 | 11/1973 | United Kingdom | 273/417 |
| 1386484 | 3/1975 | United Kingdom | 273/417 |
| 1402985 | 8/1975 | United Kingdom | 273/417 |
| 2125303 | 3/1984 | United Kingdom | 273/417 |

*Primary Examiner*—Paul E. Shapiro
*Attorney, Agent, or Firm*—Banner, Birch, McKie & Beckett

[57] ABSTRACT

A badminton shuttlecock (10) comprises a flight assembly comprising a connector element (30) in which the flight feathers (42) are received, the connector element being adjustably connected to the base (10) of the shuttlecock. Adjustment of the base relative to the connector element alters the configuration of the flights thereby altering the flight characteristics of the shuttlecock.

11 Claims, 3 Drawing Figures

SHUTTLECOCKS

TECHNICAL FIELD

The invention relates to a badminton shuttlecock.

BACKGROUND OF THE INVENTION

Conventional shuttlecocks comprise a base in which is fixed the flights which may be individual natural features or a single integral flight formed from a plastics material. In neither case is provision made for adjusting the configuration of the flights or the mass of the shuttlecock thereby to alter its flight characteristics. Moreover, no provision has been made in conventional shuttlecocks to allow the individual feathers of the flights to be replaced in the event of damage during use, or to be originally fabricated from materials with lower strength to weight ratios than natural features without loss of performance.

SUMMARY OF THE INVENTION

One aspect of the invention provides a badminton shuttlecock incorporating means whereby its 'speed' may be altered by altering the configuration and/or weight of the shuttlecock.

Adjustable 'speed' reduces the need for tight quality control in manufacture and inefficient manufacture and distribution of various weights of shuttle is eliminated. The user need not discard shuttles of incorrect speed, as at present.

Another aspect of the invention provides a badminton shuttlecock in which the individual flight feathers are wholly or partly of synthetic construction and/or of two (or more) part construction. In any or all cases, preferably, the feathers of the flights readily are replaceable. In one construction according to either of these aspects of the invention each feather has a stem received in a connector element detachably connected to the base of the shuttlecock.

BRIEF DESCRIPTION OF THE DRAWINGS

Shuttlecocks embodying the invention will now be described, by way of example, with reference to the accompanying drawings, in which.

DETAILED DESCRIPTION OF THE PREFERRED EMBODIMENTS

Figure 1:
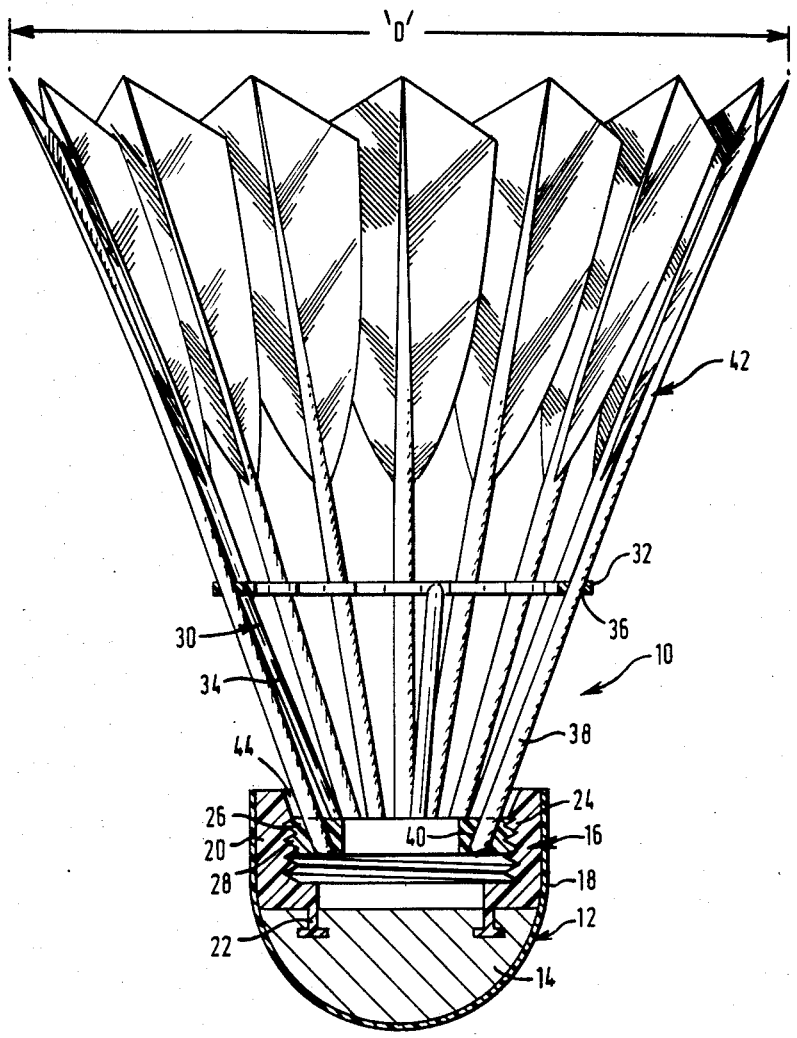
FIG. 1 is a perspective view of a badminton shuttlecock shown partly in cross-section according to one aspect of the invention, as seen from one side.
Figure 2:
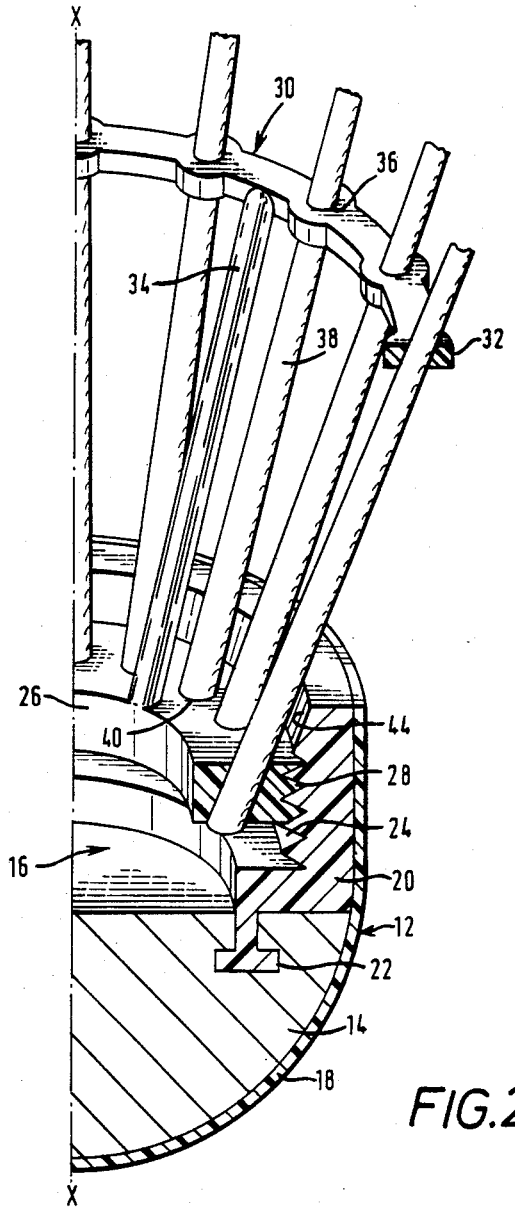
FIG. 2 is a further part-sectional view of a portion of the shuttlecock shown in FIG. 1 as seen to one side of the central vertical axis 'X—X' thereof.

Referring first to FIGS. 1 and 2 of the drawings, a badminton shuttlecock 10 has a base 12 which includes a lower solid portion 14 and an upper hollow portion 16. The base may be formed from cork or a plastics material or a combination thereof and has an outer fabric or leather type cover 18.

Upper hollow portion 16 of base 12 comprises an annular locating boss 20 which is secured to lower solid portion 14 by a downwardly extending anchoring flange 22. The upper and lower parts may be formed integrally or secured together by any suitable means.

Locating boss 20 is formed with an internal screw thread 24 to which a complimentary connector ring 26 is adjustably attached by means of an external screw thread 28. Connector ring 26 forms a part of a connector element 30 which may be formed from a plastics material and which comprises an upper bracing ring 32 which is integrally connected to connector ring 26 by means of a plurality of struts 34.

Connector element 30 receives the flights of the shuttlecock and to this end, upper bracing ring 32 is formed with a multiplicity of equi-distance spaced apertures 36 through each of which shaft 38 of a flight feather extends and is reeived in a registering aperture 40 formed in connector ring 26. As is usual, the flight feathers are arranged in an upwardly divergent annular array. Thus, bracing ring 32 is of increased diameter relative to connector rings 26. Struts 34 are disposed radially inwardly of the flights. Thus the shuttlecock comprises a base adjustable with respect to and detachable from a flight assembly which comprises connector element 30 which holds an annular array 42 of flight feathers.

When base 12 is rotated relative to connector ring 26 such that it moves upwardly of connector element 30, a shoulder portion 44 of locating boss 20 applies a radially inwardly directed force to the stems or shaft of the flight feathers at their lowermost ends, i.e., at locations adjacent connector ring 26. This causes the feathers to pivot about bracing ring 32 so that the diameter of the flight assembly, as measured across the tips of the feathers (dimension 'D') is increased, thereby decreasing the flight 'speed' of the shuttlecock. Since the stems of the flight feathers are outwardly flared it will be appreciated that the more base 12 is moved upwardly of the connector element 30 the greater is the radial inward force applied by locating boxx 20 to the stems of the flight feathers causing a proportionately larger increase in diameter 'D'.

Conversely, in order to reduce diameter 'D' thereby to increase the flight 'speed' of the shuttlecock, base 12 is rotated in the opposite direction so that it moved downwardly of connector element 30 thus reducing the radially inwardly directed force on the stems of the flight feathers. The apertures 36 in upper bracing ring 32 are such as to allow for the pivotal movement of the stems. In FIGS. 1 and 2 base 12 is shown in its lowermost position with respect to the connector element, i.e., the shuttlecock is set in a high speed mode.

In the construction described above, each of the flight feathers is separately detachable from the connector element. Such a construction in which the feathers are not permanently fixed allows for easy replacement of individual feathers damaged during use, thereby extending the lift of the shuttle. However, the flights could be permanently fixed in connector ring 26.

Figure 3:
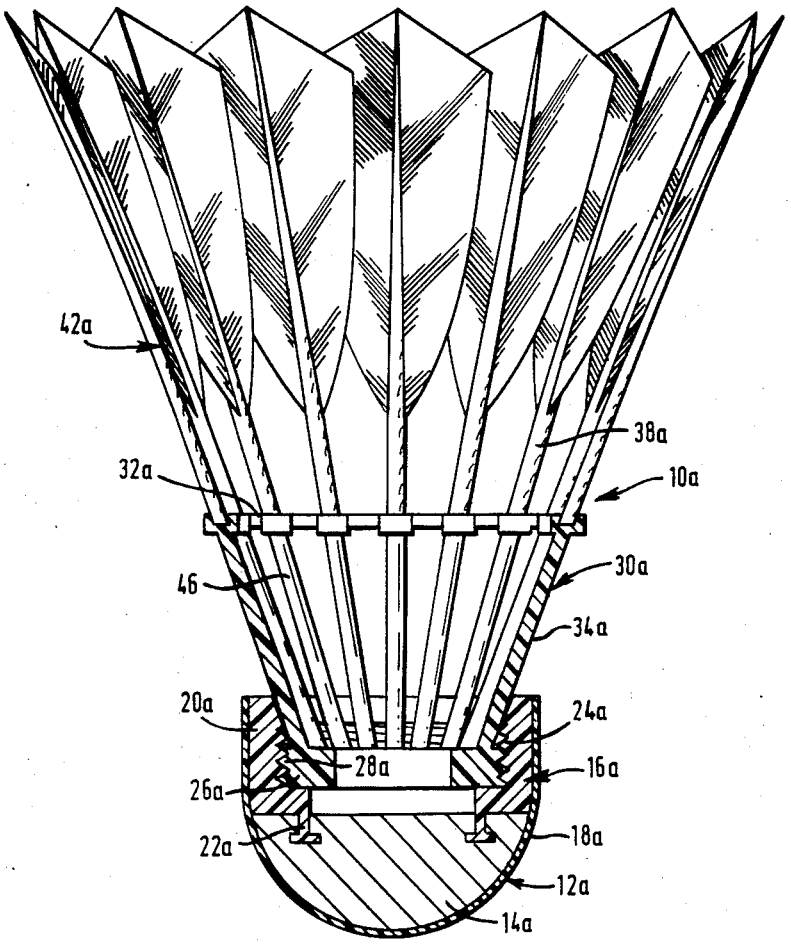
FIG. 3 is a perspective view of a modified badminton shuttlecock shown partly in cross-section and in which each feather of the flights is received in a hollow sleeve of the connecting element.

In a modified construction illustrated in FIG. 3, each of the flight feathers may be of reduced length and is received in a different connector element. In this embodiment, like parts are designated like reference numerals with the addition of suffix 'a'. The connector element **30*a* comprises an upwardly divergent annular array of separate or integral elongate sleeves 46 each of which receives the stem of a shortened flight feather. In other respects, this modified construction is similar to that described with reference to FIGS. 1 and 2. However, it will be appreciated that locating boss 20*a* acts on sleeves 46 of conector element 30*a* to alter the diameter of the flights. In this regard, a radially inwardly directed force applied by boss 20***a* at the lower ends of the sleeves tends to distort bracing ring 32*a* thus moving the feathered ends of the flight feathers radially outwardly.

In such a construction the strength of the bracing ring allows the use of comparatively low strength to weight ratio materials for construction of all or part of the individual flight feathers.

It is envisaged that the provision of partly or wholly synthetic individual flight feathers or of detachable and replaceable flight feathers may be independent of the requirement for speed adjustability. Thus, in the embodiments described with reference to FIG. 3, the connector element 30*a*, may be formed integrally with the base of the shuttlecock. Thus, the base is not adjustable with respect to the flight assembly but the flight feathers nevertheless are separately detachable from the connector element.

It is also envisaged that the 'speed' of the shuttlecock may be altered by varying its weight rather than altering the configuration of its flights. For example, in a construction where a detachable (but not necessarily adjustable) base is provided selectable weights could be removably fitted therein or otherwise attached to the shuttlecock in such location that its balance is not upset.

The flight feathers of the various embodiments of shuttlecocks referred to herein may be natural (normally selected goose feathers) or formed from a synthetic material or of composite form being partly synthetic and partly natural, and the term 'flights' or 'feathers' as used in this specification is to be interpreted accordingly.

The invention is described in detail in connection with the preferred embodiments, but these are examples only and this invention is not restricted thereto. It will be easily understood by those skilled in the art that other variations and modifications can be easily made within the scope of this invention.

I claim:

1. A badminton shuttlecock comprising a base, a plurality of flight feathers diverging upwardly from said base in an annular array, a connector element secured to said base and a bracing ring located intermediate the ends of the flight feathers above said base and with which each of the stems of the flight feathers cooperates, said connecting element and said bracing ring being joined together by a connecting structure, and said connecting element and said base being adjustably connected together by cooperating screw threads for causing an alteration in the speed of the shuttlecock.

2. A badminton shuttlecock according to claim 1, wherein stems of said flight feathers extend through said bracing ring and are received in said connecting element and wherein said base is rotatable relative to said connecting element in order to alter the diameter of the array of flight feathers.

3. A badminton shuttlecock according to claim 1, wherein said base includes an upper portion provided with a locating boss, said connecting element and said locating boss being adjustably connected together by said cooperating screw threads so that said base can be rotated relative to said connecting element to alter the diameter of the array of flight feathers.

4. A badminton shuttlecock according to claim 1, wherein rotation of said base resulting in axial movement of the base towards the ends of the flight feathers causes a portion of said base to apply a radially inwardly directed constricting force on said stems so that the distal ends of the flight feathers move radially outwardly and increase the diameter of said array of flight feathers and conversely rotation of said base resulting in axial movement of the base away from the ends of the flight feathers causes a decrease in the diameter of said array of flight feathers.

5. A badminton shuttlecock according to claim 1, wherein said connecting structure comprises a plurality of struts.

6. A badminton shuttlecock according to claim 5, wherein said struts comprise an annular array of sleeves each of which receives the stem of a flight feather.

7. A badminton shuttlecock according to claim 6, wherein each flight feather is individually detachable from its associated sleeve.

8. A badminton shuttlecock according to claim 5, wherein said struts are disposed radially inwardly of said stems.

9. A badminton shuttlecock according to claim 1, wherein each flight feather is individually detachable from said connecting element.

10. A badminton shuttlecock according to claim 1, wherein the flight feathers are at least partially constructed of synthetic material.

11. A badminton shuttlecock according to claim 1, wherein said base is detachable from said connecting element.

* * * * *